US010779577B2

(12) United States Patent
England

(10) Patent No.: US 10,779,577 B2
(45) Date of Patent: Sep. 22, 2020

(54) AEROSOL-COOLING ELEMENT AND ARRANGEMENTS FOR USE WITH APPARATUS FOR HEATING A SMOKABLE MATERIAL

(71) Applicant: British American Tobacco (Investments) Limited, London (GB)

(72) Inventor: William England, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 16/502,260

(22) Filed: Jul. 3, 2019

(65) Prior Publication Data

US 2019/0320725 A1 Oct. 24, 2019

Related U.S. Application Data

(62) Division of application No. 15/307,074, filed as application No. PCT/GB2015/051253 on Apr. 30, 2015, now Pat. No. 10,420,375.

(30) Foreign Application Priority Data

Apr. 30, 2014 (GB) ..... 1407642.6

(51) Int. Cl.
*A24F 47/00* (2020.01)
*A24D 3/04* (2006.01)
(Continued)

(52) U.S. Cl.
CPC ..... *A24F 47/008* (2013.01); *A24D 3/04* (2013.01); *A24D 3/063* (2013.01); *A24D 3/10* (2013.01);
(Continued)

(58) Field of Classification Search
CPC ..... A24F 47/004; A24F 47/006; A24F 47/008
See application file for complete search history.

(56) References Cited

U.S. PATENT DOCUMENTS 4,756,318 A * 7/1988 Clearman ..... A24F 47/004 131/196
4,898,191 A * 2/1990 Johnson ..... A24B 15/165 131/359
(Continued)

FOREIGN PATENT DOCUMENTS

AT 507187 A4 3/2010
CA 885796 11/1971
(Continued)

OTHER PUBLICATIONS

EPO, Application No. 15 725 399.8, "Communication Pursuant to Article 94(3) EPC" dated Jun. 4, 2019, 2 pages.
(Continued)

*Primary Examiner* — James Harvey
(74) *Attorney, Agent, or Firm* — Patterson Thuente Pedersen, P.A.

(57) ABSTRACT

Aerosol-cooling elements for use with an apparatus for heating smokable material are disclosed. In one example, the element is a rod having a first end and a second end and comprising at least one tube within the rod, with the at least one tube extending between the first end and the second end so as to provide a through hole extending between the first end and the second end of the rod.

5 Claims, 6 Drawing Sheets

(51) Int. Cl.

| | |
|---|---|
| ***A24D 3/10*** | (2006.01) |
| ***A24D 3/16*** | (2006.01) |
| ***A24D 3/06*** | (2006.01) |
| ***A24F 7/04*** | (2006.01) |

(52) U.S. Cl.

CPC ..... *A24D 3/163* (2013.01); *A24F 7/04* (2013.01); *A24F 47/004* (2013.01); *A24F 47/006* (2013.01)

(56) References Cited

U.S. PATENT DOCUMENTS

| | | | | |
|---|---|---|---|---|
| 4,913,169 | A | 4/1990 | Templeton | |
| 5,027,836 | A | 7/1991 | Shannon | |
| 5,027,839 | A | 7/1991 | Shannon | |
| 5,115,820 | A | 5/1992 | Hauser | |
| 5,327,915 | A * | 7/1994 | Porenski | A24F 47/004 131/194 |
| 5,611,360 | A * | 3/1997 | Tang | A24F 47/004 131/194 |
| 5,820,967 | A | 10/1998 | Gadkaree | |
| 6,089,857 | A * | 7/2000 | Matsuura | A61M 15/06 431/142 |
| 6,814,786 | B1 | 11/2004 | Zhuang | |
| 7,160,366 | B2 | 1/2007 | Blackburn | |
| 9,259,031 | B2 | 2/2016 | Branton | |
| 2004/0194792 | A1 | 10/2004 | Zhuang | |
| 2005/0133051 | A1 | 6/2005 | Luan | |
| 2005/0133054 | A1 | 6/2005 | Fournier | |
| 2006/0144412 | A1 | 7/2006 | Mishra | |
| 2006/0201524 | A1 | 9/2006 | Zhang | |
| 2008/0092912 | A1 | 4/2008 | Robinson | |
| 2008/0110470 | A1 | 5/2008 | Zhang | |
| 2011/0226236 | A1 | 9/2011 | Buchberger | |
| 2012/0318882 | A1 | 12/2012 | Abehasera | |
| 2013/0133675 | A1 | 5/2013 | Shinozaki | |
| 2013/0192620 | A1 | 8/2013 | Tucker | |
| 2014/0166029 | A1 | 6/2014 | Weigensberg | |
| 2014/0261486 | A1 | 9/2014 | Potter | |
| 2014/0299125 | A1 | 10/2014 | Buchberger | |
| 2014/0305449 | A1 | 10/2014 | Plojoux | |
| 2014/0373856 | A1* | 12/2014 | Zuber | A24F 47/008 131/328 |
| 2015/0027454 | A1 | 1/2015 | Li | |
| 2015/0163859 | A1* | 6/2015 | Schneider | A24F 47/008 131/329 |
| 2015/0196059 | A1 | 7/2015 | Liu | |
| 2015/0257447 | A1 | 9/2015 | Sullivan | |
| 2016/0120224 | A1 | 5/2016 | Mishra | |
| 2016/0174610 | A1 | 6/2016 | Kuczaj | |
| 2016/0255879 | A1 | 9/2016 | Paprocki | |
| 2017/0143038 | A1 | 5/2017 | Dickens | |
| 2017/0347706 | A1 | 12/2017 | Aoun et al. | |
| 2018/0027882 | A1 | 2/2018 | Hepworth et al. | |
| 2018/0035719 | A1 | 2/2018 | Turner et al. | |
| 2018/0360122 | A1 | 12/2018 | Aoun et al. | |
| 2019/0216132 | A1* | 7/2019 | Phan | A24F 47/008 |
| 2019/0320725 | A1* | 10/2019 | England | A24D 3/10 |

FOREIGN PATENT DOCUMENTS

| | | | |
|---|---|---|---|
| CA | 2330782 | | 7/2002 |
| CA | 2925645 | A1 | 4/2015 |
| CN | 1054887 | | 10/1991 |
| CN | 101433818 | | 5/2009 |
| CN | 101557728 | | 10/2009 |
| CN | 102834027 | | 12/2012 |
| CN | 103315402 | A | 9/2013 |
| CN | 103892467 | | 7/2014 |
| CN | 204273243 | U | 4/2015 |
| DE | 2940535 | | 10/1980 |
| EP | 0 174 645 | A2 | 3/1986 |
| EP | 0254551 | | 1/1988 |
| EP | 0 307 118 | | 8/1988 |
| EP | 0 352 106 | A2 | 1/1990 |
| EP | 0 535 695 | A2 | 4/1993 |
| EP | 0585016 | | 3/1994 |
| EP | 845220 | | 6/1998 |
| EP | 2489391 | A1 | 8/2012 |
| EP | 2625975 | | 8/2013 |
| EP | 2625975 | A1 | 8/2013 |
| EP | 3127443 | | 2/2017 |
| JP | 06064983 | | 3/1994 |
| JP | 2009191148 | | 8/2009 |
| JP | 2012506263 | | 3/2012 |
| JP | 2014 529996 | A | 11/2014 |
| JP | 2015504667 | | 2/2015 |
| JP | 2017-529896 | | 10/2017 |
| KR | 20120053521 | | 5/2012 |
| KR | 20140118982 | | 10/2014 |
| WO | WO 98/28994 | | 12/1997 |
| WO | WO 9828994 | | 7/1998 |
| WO | WO 9748293 | | 11/1998 |
| WO | WO 2001/030184 | | 5/2001 |
| WO | WO 2001030184 | | 5/2001 |
| WO | WO 03008068 | | 1/2003 |
| WO | WO 03/034847 | A1 | 5/2003 |
| WO | WO 03034847 | | 5/2003 |
| WO | WO 2004086888 | | 10/2004 |
| WO | WO 2004087309 | | 10/2004 |
| WO | WO 2006048766 | | 5/2006 |
| WO | WO 2006070291 | | 7/2006 |
| WO | WO 2006072889 | | 7/2006 |
| WO | WO 2006089404 | | 8/2006 |
| WO | WO 2006097852 | | 9/2006 |
| WO | WO 2006103404 | | 10/2006 |
| WO | WO 2006109189 | | 10/2006 |
| WO | WO 2007031876 | | 3/2007 |
| WO | WO 2007036814 | | 4/2007 |
| WO | WO 2007069093 | | 6/2007 |
| WO | WO 2012/051548 | | 4/2012 |
| WO | WO 2013034458 | | 3/2013 |
| WO | WO 2013/102309 | | 7/2013 |
| WO | WO 2014/116974 | | 7/2014 |
| WO | WO 2014/116974 | A1 | 7/2014 |
| WO | WO 2015/046385 | A1 | 4/2015 |
| WO | WO 2015/128499 | A1 | 9/2015 |
| WO | WO 2015/179388 | A1 | 11/2015 |
| WO | WO 2016/062777 | A1 | 4/2016 |

OTHER PUBLICATIONS

Application and File History for U.S. Appl. No. 15/307,074, filed Oct. 27, 2016, Inventor: William England.

Chinese Office Action, Application No. 201580023549.5, dated Jul. 2, 2018, 23 pages.

International Search Report, Application No. PCT/EP2015/074395, dated Feb. 1, 2016, 2 pages.

International Preliminary Report on Patentability, International Application No. PCT/EP2016/054232, dated Jul. 3, 2017, 10 pages.

International Search Report, International Application No. PCT/EP2016/054232, dated Aug. 24, 2016, 5 pages.

Partial International Search Report, International Application No. PCT/EP2016/054232, dated Jun. 22, 2016, 6 pages.

Application and File History for U.S. Appl. No. 15/553,742, filed Aug. 25, 2017, Inventor: Turner.

International Preliminary Report on Patentability, International Application no. PCT/EP2016/054159, dated Jul. 14, 2017, 7 pages.

International Search Report, International Application No. PCT/EP2016/054159, dated Jun. 9, 2016, 3 pages.

Australian Examination Report, Application No. 2015334902, dated Dec. 22, 2017, 3 pages.

Definition of "throughout," the Free Merriam-Webster Dictionary, retrieved from the Internet on Mar. 7, 2015, available at: http://www.merriam-webster.com/dictionary/throughout.

International Search Report and Written Opinion, dated Sep. 17, 2012 for PCT/GB2012/051257, filed Jun. 1, 2012, 7 pages.

Written Opinion of the IPEA, dated May 29,2013 for PCT/GB2012/051257, filed Jun. 1, 2012.

(56) References Cited

OTHER PUBLICATIONS

International Preliminary Report on Patentability, dated Jul. 12,2013 for PCT/GB2012/051257, filed Jun. 1, 2012, 20 pages.
Korean Office Action, Application No. 10-2017-7013874, dated Oct. 30, 2018, 9 pages (19 pages with translation).
European Communication, Application No. 15793718.6, dated Dec. 20, 2018, 5 pages.
Japanese Office Action, Application No. 2017-545230, dated Nov. 6, 2018, 10 pages.
Japanese Office Action, Application No. 2017-545245, dated Oct. 30, 2018, 11 pages.
Japanese Office Action, Application No. 2017-522122, dated Feb. 5, 2019, 7 pages.
JAC Vapour E-Cigarettes & E-Liquids, Round Rubber Mouth Tips, www.jacapour.com , 2 pages, May 29 , 2015.
GB Search Report, Application No. GB1517470.9, dated Mar. 21, 2016, 4 pages.
Communication Relating to the Results of the Partial International Search Report, International Application No. PCT/EP2016/054232, dated Jun. 22, 2016, 6 pages.
European Examination Report, Application No. 15725399.8, dated Jun. 4, 2019, 5 pages.
Australian Patent Examination Report, Application No. 2015334902, dated Dec. 22, 2017, 3 pages.
Japanese Office Action, Application No. 2018-20388, dated Jul. 15, 2020 , 2 pages.

* cited by examiner

AEROSOL-COOLING ELEMENT AND ARRANGEMENTS FOR USE WITH APPARATUS FOR HEATING A SMOKABLE MATERIAL

CROSS-REFERENCE TO RELATED APPLICATIONS

This application is a division of application Ser. No. 15/307,074 filed Oct. 27, 2016, which in turn is a National Phase entry of PCT Application No. PCT/GB2015/051253, filed on 30 Apr. 2015, which claims priority to GB Patent Application No. 1407642.6, filed on 30 Apr. 2014, each of which is hereby fully incorporated herein by reference.

TECHNICAL FIELD

The present disclosure relates to an aerosol-cooling element and to arrangements for use with apparatus for heating a smokable material.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are so-called heat-not-burn products, also known as tobacco heating products or tobacco heating devices, which release compounds by heating, but not burning, the material. The material may be for example tobacco or other non-tobacco products, which may or may not contain nicotine.

SUMMARY

According to a first aspect of the present disclosure, there is provided an aerosol-cooling element for use with an apparatus for heating smokable material, the element being a monolithic rod having first and second ends and comprising plural through holes extending between the first and second ends.

In an embodiment, the through holes extend substantially parallel to the central longitudinal axis of the rod.

In an embodiment, the through holes are arranged generally radially of the element when viewed in lateral cross-section. That is, in an example, the element has internal walls which define the through holes and which have two main configurations, namely radial walls and central walls. The radial walls extend along radii of the cross-section of the element and the central walls are centered on the center of the cross-section of the element. The central walls in one example are circular, though other regular or irregular cross-sectional shapes may be used. Likewise, the cross-section of the element in one example is circular, though other regular or irregular cross-sectional shapes may be used.

In an embodiment, the majority of the through holes have a hexagonal or generally hexagonal cross-sectional shape. In this embodiment, the element has what might be termed a "honeycomb" structure when viewed from one end.

In an embodiment, the element is substantially incompressible.

In an embodiment, the element is formed of a ceramic material.

In an embodiment, the element is formed of a polymer. The element may be formed of a thermoplastic polymer.

In an embodiment, the element is formed of an extrudable plastics material.

In an embodiment, the porosity of the element is in the range 60% to 75%. The porosity in this sense may be a measure of the percentage of the lateral cross-sectional area of the element occupied by the through holes. In an embodiment, the porosity of the element is around 69% to 70%.

According to a second aspect of the present disclosure, there is provided an aerosol-cooling element for use with an apparatus for heating smokable material, the element being a rod having first and second ends and comprising at least one tube within the rod, the tube extending between the first and second ends so as to provide a through hole extending between the first and second ends of the rod.

In an embodiment, the rod is formed of a first material and the at least one tube is formed of a second, different material.

In an embodiment, the rod is formed of cellulose acetate.

In an embodiment, the rod is formed of a cellulose acetate tow.

In an embodiment, the at least one tube is formed of at least one of silicone rubber, ethylene vinyl acetate, and polypropylene.

In an embodiment, the element comprises plural tubes within the rod and extending between the first and second ends, providing plural through holes extending between the first and second ends of the rod.

According to a third aspect of the present disclosure, there is provided an aerosol-cooling element for use with an apparatus for heating smokable material, the element being a rod having first and second ends and comprising plural activated carbon fibers within the rod, the activated carbon fibers extending between the first and second ends of the rod.

In an embodiment, the activated carbon fibers are substantially aligned with one another.

In an embodiment, the rod consists of activated carbon fibers held together by an outer wrap.

In an embodiment, the element comprises activated carbon fibers embedded or dispersed within a second, different material.

In an embodiment, the second, different material comprises cellulose acetate.

In an embodiment, the second, different material comprises a cellulose acetate tow. According to a fourth aspect of the present disclosure, there is provided an aerosol-cooling element for use with an apparatus for heating smokable material, the element being a rod having first and second ends, the rod being formed as a matrix of a first material containing particles of a second material.

In an embodiment, the first material comprises at least one polymer.

In an embodiment, the second material comprises carbon.

There may be provided a cooling assembly for use with an apparatus for heating smokable material, the cooling assembly comprising: an aerosol-cooling element as described above for cooling volatilized smokable material; and a tube at one end of the aerosol-cooling element.

In an embodiment, said tube is a hollow tube for providing a filtering function to filter volatilized smokable material.

In an embodiment, the cooling assembly comprises comprising a second tube at the other end of the aerosol-cooling element.

There may be provided a smoking article for use with an apparatus for heating smokable material, the smoking article comprising: smokable material; and an aerosol-cooling element as described above for cooling volatilized smokable material produced when the smokable material is heated.

In an embodiment, the smoking article comprises a spacer between the smokable material and the aerosol-cooling element. In an embodiment, the spacer is a hollow spacer tube.

In an embodiment, the smoking article comprises a hollow mouth end tube at an end of the aerosol-cooling element. In an embodiment, the mouth end tube is arranged to provide a filtering function to filter volatilized smokable material produced when the smokable material is heated.

BRIEF DESCRIPTION OF THE DRAWINGS

Embodiments of the disclosure will now be described, by way of example only, with reference to the accompanying drawings, in which.

DETAILED DESCRIPTION

Figure 1:
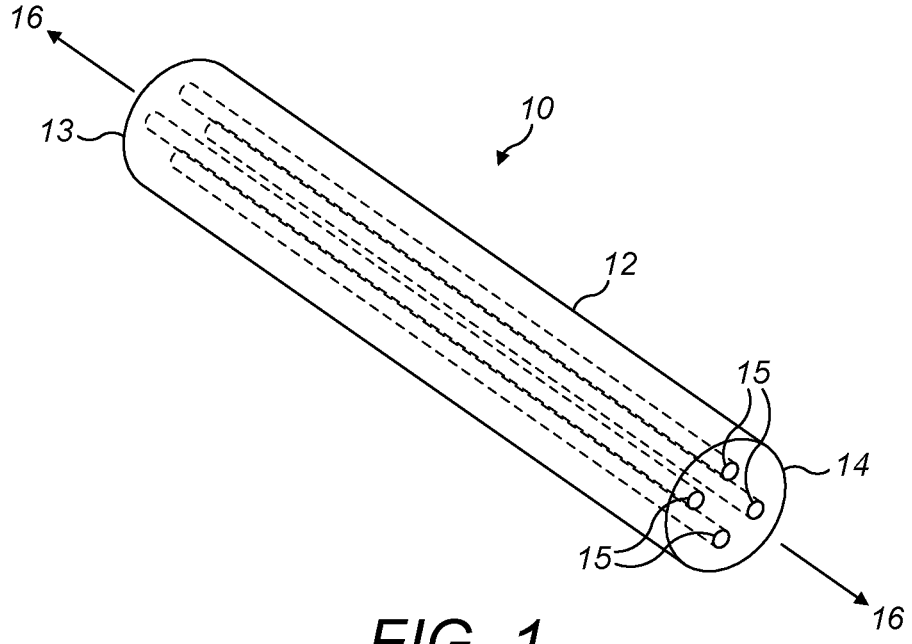
FIG. 1 shows a schematic perspective view of a first example of an aerosol-cooling element for use with an apparatus for heating smokable material.

As used herein, the term "smokable material" includes materials that provide volatilized components upon heating, typically in the form of an aerosol. "Smokable material" includes any tobacco-containing material and may, for example, include one or more of tobacco, tobacco derivatives, expanded tobacco, shredded tobacco, reconstituted tobacco or tobacco substitutes. "Smokable material" also may include other, non-tobacco, products, which, depending on the product, may or may not contain nicotine.

Apparatus is known that heats smokable material to volatilize at least one component of the smokable material, typically to form an aerosol which can be inhaled, without burning or combusting the smokable material. Such apparatus is sometimes described as a "heat-not-burn" apparatus or a "tobacco heating product" or "tobacco heating device" or similar. The apparatus is typically generally elongate, having an open end, sometimes referred to as the mouth end. The smokable material may be in the form of or provided as part of a cartridge or cassette or rod which can be inserted into the apparatus. A filter arrangement may be provided at the mouth end to filter and/or cool volatilized material as the material is drawn by the user. A heater for heating and volatilizing the smokable material may be provided as a "permanent" part of the apparatus or may be provided as part of the smoking article or consumable which is discarded and replaced after use. A "smoking article" in this context is a device or article or other component that includes the smokable material, which in use is heated to volatilize the smokable material, and optionally other components. In use, particularly in the present principal applications, the smokable material is not burnt or combusted.

A particular problem with such heat-not-burn apparatus is cooling the volatilized material before it reaches the user. High temperatures are required to heat the smokable material, and the smokable material is often in close proximity to the mouth end of the apparatus. Moreover, unlike for example a conventional cigarette, the volatilized material typically does not pass though a relatively lengthy body of smokable material before reaching the user. Moreover, the outer housing of a heat-not-burn apparatus is often thermally insulated from the chamber where the smokable material is heated and from the passageway through which the volatilized material passes. As a result, the volatilized material is typically subject to little cooling during its passage through the apparatus.

Certain examples of embodiments of the present disclosure provide for cooling of the volatilized material or aerosol which is produced in use by such apparatus. In certain examples of embodiments of the present invention, such cooling may be achieved with little or no filtering function, or at least little or no filtering function beyond or in addition to any filtering that is performed by any associated filter which may be provided in use for the apparatus. That is, the primary concern of examples of embodiments of cooling elements of the present disclosure is to provide for cooling of the volatilized material or aerosol, and filtering is not a particular concern and is not addressed by the cooling element per se. In this regard, as noted above, achieving cooling of smoke in a conventional cigarette is normally not a particular concern as the smoke will typically have cooled sufficiently on its passage to the user anyway. Heat-not-burn apparatus or tobacco heating products/devices therefore present their own different problems and difficulties in this regard. The cooling elements described herein may be provided as part of the main apparatus (which typically includes a power supply, control circuitry and the like), and/or as part of the consumable (which is inserted into or otherwise engaged with the main apparatus and discarded and replaced after use), with the heater for heating the tobacco or other smokable material of the consumable being provided as part of the main apparatus or the consumable or both.

Referring now to FIG. 1, there is shown a schematic perspective view of a first example of an aerosol-cooling element 10 for use with an apparatus for heating and volatilizing smokable material. In this example, the element 10 is cylindrical having a circular cross-section. In this example, the element 10 is a monolithic rod 12. That is, the rod 12 is a block of a single material. The rod 12 has first and second ends 13, 14. In use, one end 13 will be located towards the smokable material and the heater of the heating apparatus with which the element 10 is used and the other end 14 will be located at or towards the mouth end.

The element 10 of FIG. 1 has plural through holes 15 extending between the first and second ends 13, 14. In the example shown, the through holes 15 extend generally parallel to each other and extend substantially parallel to the central longitudinal axis 16 of the rod 12. However, other arrangements are possible. For example, not all the through holes 15 need be parallel to each other. In another example, some or all of the through holes 15 are not parallel to the central longitudinal axis 16 of the rod 12. In use, the aerosol or volatilized material passes through the through holes 15, allowing heat to be conducted from the aerosol or volatilized material to cool the aerosol or volatilized material.

The element 10 of FIG. 1 in one example is substantially incompressible, that is, the element 10 is reasonably rigid and relatively large forces are required to compress the element 10. In this way, the element 10 can be self-supporting, requiring no further arrangement to support the element 10 in use.

In one example, the element 10 of FIG. 1 is formed of a ceramic material. A ceramic material is an inorganic, non-metallic material, often a crystalline oxide, nitride or carbide material. Suitable examples include silicon carbide (SiC), silicon nitride (Si3N4), titanium carbide, and zirconium dioxide (zirconia), though other ceramic or non-ceramic materials may be used. In other examples the element 10 of FIG. 1 is formed of at least one polymer. The polymer may be for example a thermoplastic, such as for example a polyolefin, a polyester, a polyamides (or nylon, including for example nylon 6), a polyacrylic, a polystyrene, a polyvinyl, polytetrafluoroethylene (PTFE), polyether ether ketone (PEEK), a polyether block amide; a polyolefin such as for example polyethylene, polypropylene, polybutylene and polymethylpentene; a polyester; a polyacrylic; a polystyrene; a polyvinyl such as for example ethylene vinyl acetate, ethylene vinyl alcohol and polyvinyl chloride; and any copolymer thereof, any derivative thereof, and any combination thereof.

The element 10 of FIG. 1 may be formed initially as a solid block and the through holes 15 formed by piercing or boring through the block. More efficiently however, the element 10 of FIG. 1 may be formed initially with the through holes 15, for example by some suitable molding technique, which may optionally include extrusion and/or pultrusion for example.

Figure 2:
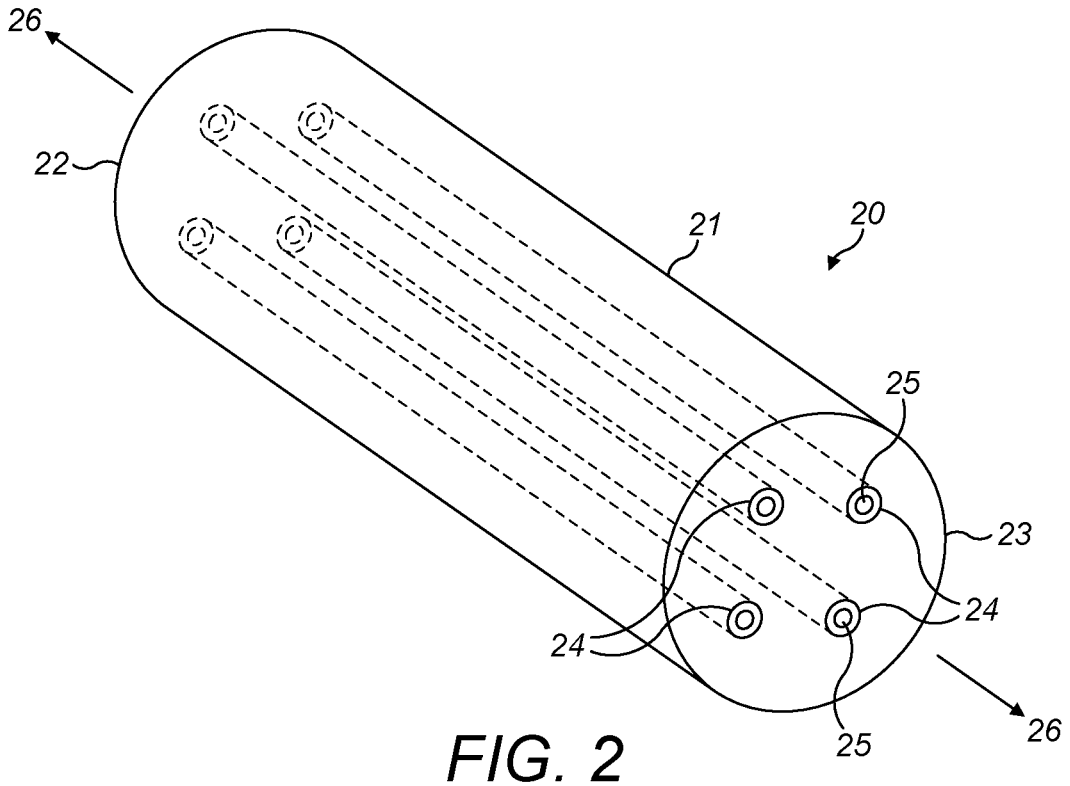
FIG. 2 shows a schematic perspective view of a second example of an aerosol-cooling element for use with an apparatus for heating smokable material.

Referring now to FIG. 2, there is shown a schematic perspective view of a second example of an aerosol-cooling element 20 for use with an apparatus for heating and volatilizing smokable material. In this example, the element 20 is cylindrical having a circular cross-section. In this example, the element 20 is a rod 21 having first and second ends 22, 23. In use, one end 22 will be located towards the smokable material and the heater of the heating apparatus with which the element 20 is used and the other end 23 will be located at or towards the mouth end.

The element 20 of FIG. 2 has at least one tube 24 within the rod 21, the tube 24 extending between the first and second ends 22, 23 so as to provide a through hole 25 extending between the first and second ends 22, 23 of the rod 21. There are preferably plural such tubes 24 providing plural through holes 25 through the rod 21. In the example shown, the tubes 24 and through holes 25 extend generally parallel to each other and extend substantially parallel to the central longitudinal axis 26 of the rod 21. However, other arrangements are possible. For example, not all the tubes 24 and through holes 25 need be parallel to each other. In another example, some or all of the tubes 24 and through holes 215 are not parallel to the central longitudinal axis 26 of the rod 21. In use, the aerosol or volatilized material passes through the through holes 25, allowing heat to be conducted from the aerosol or volatilized material to cool the aerosol or volatilized material.

The element 20 of FIG. 2 in one example is substantially incompressible. In this way, the element 20 can be self-supporting, requiring no further arrangement to support the element 20 in use.

In an example of the element 20 of FIG. 2, the main body portion or rod 21 is formed of a first material and the or each tube 24 is formed of a second, different material. In an example, the main body portion or rod 21 is formed of cellulose acetate. In an example, the main body portion or rod 21 is formed of a cellulose acetate tow. As is known per se, a tow is an untwisted bundle of continuous filaments, in this example a ribbon consisting of many cellulose acetate strands. In an example, the or each tube 24 is formed of at least one of silicone rubber, ethylene vinyl acetate, and polypropylene. Other materials may be used. One or more of the various tubes 24 may be formed of different materials from the others. The main body portion or rod 21 and the or each tube 24 may be formed as a block and then stretched or co-extruded to the desired diameter.

Figure 3:
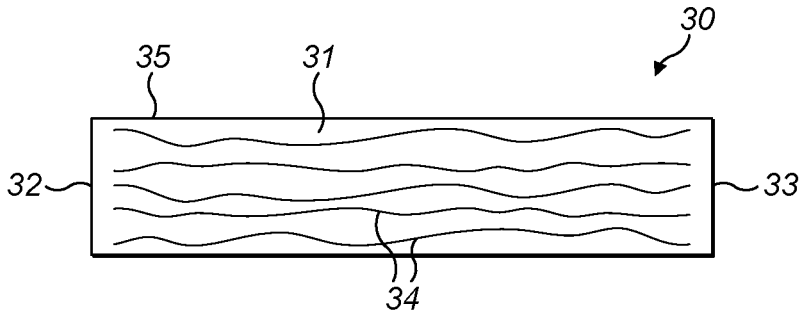
FIG. 3 shows a schematic side view of another example of an aerosol-cooling element for use with an apparatus for heating smokable material.

Referring now to FIG. 3, there is shown a schematic side view of another example of an aerosol-cooling element 30 for use with an apparatus for heating and volatilizing smokable material. In this example, the element 30 is cylindrical having a circular cross-section. In this example, the element 30 is a rod 31 having first and second ends 32, 33. In use, one end 32 will be located towards the smokable material and the heater of the heating apparatus with which the element 30 is used and the other end 33 will be located at or towards the mouth end.

The element 30 of FIG. 3 has plural activated carbon fibers or threads 34 extending between the first and second ends 32,33. It will be understood that this is shown only schematically in FIG. 3 and that there may be hundreds or even thousands of such fibers 34. As is known per se, "activated" carbon is a form of carbon that has been processed to so as to have very many small, low-volume pores which increase dramatically the surface area of the carbon. In the example shown the activated carbon fibers 34 are substantially aligned with one another. In use, the aerosol or volatilized material passes along the activated carbon fibers 34, allowing heat to be conducted from the aerosol or volatilized material to cool the aerosol or volatilized material. The activated carbon fibers or threads 34 may be formed solely of carbon. In another example, the activated carbon fibers or threads 34 may be formed by for example pulling a thread of material through a glue or other adhesive bath and then applying carbon fibers to the thread, with the carbon fibers adhering to the thread by virtue of the glue. The thread material in that case may be for example cellulose acetate.

In one arrangement, the rod 31 consists of the activated carbon fibers 34, which are held together by an outer wrap or sheath 35, with no other material being present. The wrap 35 may be formed of a material such as paper. In another arrangement, the rod 31 is formed from the activated carbon fibers 34 which are embedded or dispersed within a second, different material. The second, different material may be for example cellulose acetate, including for example a cellulose acetate tow.

The element 30 of FIG. 3 in one example is substantially incompressible. In this way, the element 30 can be self-supporting, requiring no further arrangement to support the element 30 in use.

Figure 4:
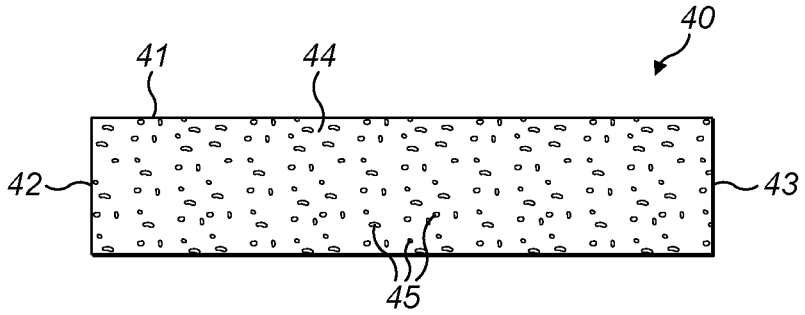
FIG. 4 shows a schematic side view of another example of an aerosol-cooling element for use with an apparatus for heating smokable material.

Referring now to FIG. 4, there is shown a schematic side view of another example of an aerosol-cooling element 40 for use with an apparatus for heating and volatilizing smokable material. In this example, the element 40 is cylindrical having a circular cross-section. In this example, the element 40 is a rod 41 having first and second ends 42, 43. In use, one end 42 will be located towards the smokable material and the heater of the heating apparatus with which the element 40 is used and the other end 43 will be located at or towards the mouth end.

The element 40 of FIG. 4 is formed as a matrix composed of a body portion 44 of a first material containing particles 45 of a second material. (It will be understood that FIG. 4 is schematic and that there will typically be thousands or tens of thousands or more of particles 45.)

In an example, the first material of the body portion 44 comprises at least one polymer. The polymer may be for example a thermoplastic, such as for example a polyolefin, a polyester, a polyamides (or nylon, including for example nylon 6), a polyacrylic, a polystyrene, a polyvinyl, polytetrafluoroethylene (PTFE), polyether ether ketone (PEEK), a polyether block amide; a polyolefin such as for example polyethylene, polypropylene, polybutylene and polymethylpentene; a polyester; a polyacrylic; a polystyrene; a polyvinyl such as for example ethylene vinyl acetate, ethylene vinyl alcohol and polyvinyl chloride; and any copolymer thereof, any derivative thereof, and any combination thereof. The first material of the body portion 44 may be a water-soluble resin.

In an example, the second material of the particles 45 comprises carbon. The carbon may be activated carbon.

The element 40 may be formed for example by mixing the particles 45 with the material of the body portion 44, extruding the mixture, and then microwaving the mixture to cure it.

Figure 5:
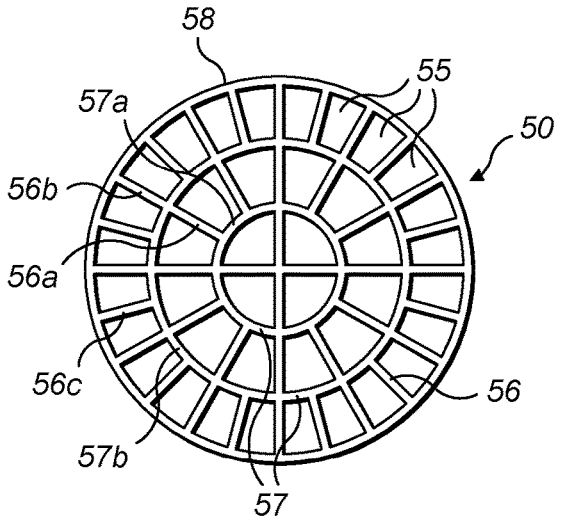
FIG. 5 shows a schematic end view of another example of an aerosol-cooling element for use with an apparatus for heating smokable material.

Referring now to FIG. 5, there is shown a schematic end view of another example of an aerosol-cooling element 50 for use with an apparatus for heating and volatilizing smokable material. In this example, the element 50 is again cylindrical, in this case having a circular cross-section (as can be seen in FIG. 5) though other cross-sectional shapes are possible, including for example square, rectangular or other quadrilateral, other polygonal, which may be regular or irregular, including for example pentagonal, octagonal, etc., etc. In this example, the element 50 is a monolithic rod, that is, the rod is a block of a single material. In use, one end of the rod-like element 50 will be located towards the smokable material and the heater of the heating apparatus with which the element 50 is used and the other end will be located at or towards the mouth end.

The element 50 of FIG. 5 has plural through holes or lumen 55 extending between the first and second ends. In the example shown, the through holes 55 extend generally parallel to each other and extend substantially parallel to the central longitudinal axis of the rod-like element 50. However, other arrangements are possible. For example, not all the through holes 55 need be parallel to each other. In another example, some or all of the through holes 55 are not parallel to the central longitudinal axis of the rod-like element 50. In use, the aerosol or volatilized material passes through the through holes 55, allowing heat to be conducted from the aerosol or volatilized material to cool the aerosol or volatilized material.

In this example, the through holes 55 when viewed in lateral cross-section (as shown in FIG. 5) are arranged generally radially. That is, the internal walls of the element 50 which define the through holes 55 have two main configurations, namely radial walls 56 and central walls 57. The radial walls 56 extend along radii of the cross-section of the element 50. The central walls 57 pass generally around the center of the cross-section of the element 50. In the example shown, the central walls 57 are circular, though other shapes are possible, and may for example be regular or irregular polygons, optionally following the general cross-sectional shape of the element 50 as a whole. There may be for example a first, innermost central wall 57*a* and a second central wall 57*b* located radially outwards of the first, innermost central wall 57*a*. Further central walls may be provided. Radial walls 56 may extend between the innermost central wall 57*a* and the second central wall 57*b*. Further radial walls 56 may extend between the second central wall 57*b* and the outermost wall 58 of the element 50. Depending on the flow arrangement and cooling effect that is required, some or all of the radial walls 56 that extend between the innermost central wall 57*a* and the second central wall 57*b* may be radially aligned with the radial walls 56 that extend between the second central wall 57*b* and the outermost wall 58 of the element 50. Likewise, in the example shown, there are no radial walls provided radially inwardly of the innermost central wall 57*b* so that the center of the element 50 is open, though one or more radial walls and/or other non-radial walls and/or other projections may extend into or across the center of the element 50. Moreover, the radial walls 56 are regularly angularly spaced from each other, so that the radial angle between each pair of radial walls 56 is the same, but this need not be the case and respective pairs of radial walls may have different angular separations. This all allows for a flexible design for the element 50 so that the effective porosity of the element 50 to air or vapor flow can be set to be a predetermined or desired value. Correspondingly, the effective surface area within the element 50 that is exposed to the vapor or aerosol passing through can be controlled or set to a desired value; it has been found that the effective surface area within the element is one of the main factors in determining the amount of cooling that is achieved. All of these factors enable better control of the cooling that is achieved in use, as well has in some cases enabling better control of aspects such as the droplet size of the vapor that passes through the element 50 in use as well as the amount of vapor that might condense during passage through the element 50.

In the specific example of FIG. 5, each of the radial walls 56*a* that extends between the innermost central wall 57*a* and the second central wall 57*b* is radially aligned with a respective one of the radial walls 56*b* that extend between the second central wall 57*b* and the outermost wall 58 of the element 50. In addition, further radial walls 56*c* are provided between the second central wall 57*b* and the outermost wall 58 of the element 50. In this example, the further "intermediate" radial walls 56*c* are positioned midway between the other radial walls 56*b* that extend between the second central wall 57*b* and the outermost wall 58 of the element 50, though other arrangements are possible.

In the specific example of FIG. 5, there are 28 (twenty-eight) through holes 55 which are sized and arranged such that the overall porosity longitudinally through the element 50 is around 69% (that is, the total cross-sectional area defined by the through holes 55 is around 69% of the total cross-sectional area and the cross-sectional area defined by the radial walls 56 and the central walls 57 is around 31% of the total cross-sectional area). In general, a porosity of between around 60% to 75%, or more particularly around 65% to 72%, and even more particularly around 69% to 70%, has been found to perform well.

Figure 6:
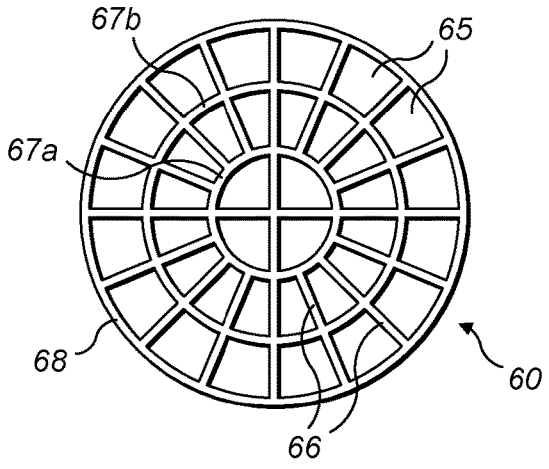
FIG. 6 shows a schematic end view of another example of an aerosol-cooling element for use with an apparatus for heating smokable material.

Referring now to FIG. 6, there is shown a schematic end view of another example of an aerosol-cooling element 60 for use with an apparatus for heating and volatilizing smokable material. In this example, the element 60 is again cylindrical having a circular cross-section (as can be seen in FIG. 6), though again other cross-sectional shapes are possible. In this example, the element 60 is a monolithic rod, that is, the rod is a block of a single material, and has plural through holes or lumen 65.

The example of FIG. 6 is similar in many respects to the example of FIG. 5 and similar options and alternatives to those discussed above are available. Accordingly, for the sake of brevity, the description of the same or similar aspects and options or alternatives will not be repeated here and only the main differences will be discussed.

In the example of FIG. 6, each radial wall 66*a* that extends between the innermost central wall 67*a* and the second central wall 67*b* is radially aligned with a respective one of the radial walls 66*b* that extend between the second central wall 67*b* and the outermost wall 68 of the element 60, and vice versa. That is, compared with the example of FIG. 5, there are no intermediate radial walls between the outermost radial walls 66*b* (which are aligned with respective ones of the radial walls 66*a* that extend between the innermost central wall 67*a* and the second central wall 67*b*, as discussed). In this example, there are 36 through holes 65 which are sized and arranged such that the overall porosity longitudinally through the element 60 is around 65% to 66%.

Figure 7:
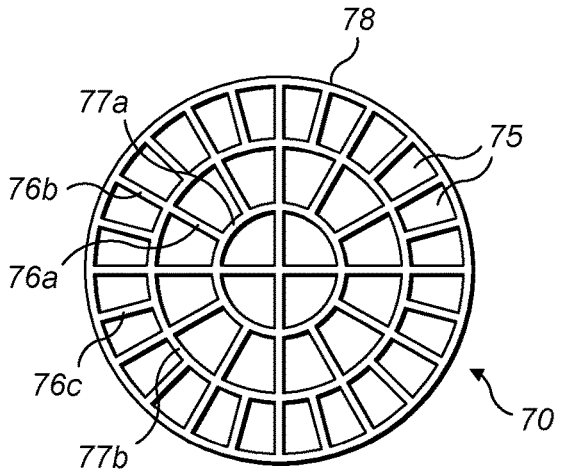
FIG. 7 shows a schematic end view of another example of an aerosol-cooling element for use with an apparatus for heating smokable material.

Referring now to FIG. 7, there is shown a schematic end view of another example of an aerosol-cooling element 70 for use with an apparatus for heating and volatilizing smokable material. In this example, the element 70 is again cylindrical having a circular cross-section (as can be seen in FIG. 7), though again other cross-sectional shapes may be used. In this example, the element 70 is a monolithic rod, that is, the rod is a block of a single material, and has plural through holes or lumen 75.

The example of FIG. 7 is similar in many respects to the example of FIG. 5 and similar options and alternatives to those discussed above are available. Accordingly, for the sake of brevity, the description of the same or similar aspects and options or alternatives will not be repeated here and only the main differences will be discussed.

Similarly to the example of FIG. 5, in the specific example of FIG. 7, each of the radial walls 76*a* that extends between the innermost central wall 77*a* and the second central wall 77*b* is radially aligned with a respective one of the radial walls 76*b* that extend between the second central wall 77*b* and the outermost wall 78 of the element 50; and, in addition, further radial walls 76*c* are provided between the second central wall 77*b* and the outermost wall 78 of the element 70. In this example, the further "intermediate" radial walls 76*c* are positioned midway between the other radial walls 76*b* that that extend between the second central wall 77*b* and the outermost wall 78 of the element 70, though other arrangements are possible. In this example, the radial or angular separation between radial walls is smaller than for the example for FIG. 5, so there are more through holes 75. In this specific example, there are 40 (forty) through holes 75, 55 which are sized and arranged such that the overall porosity longitudinally through the element 70 is around 64%.

Figure 8:
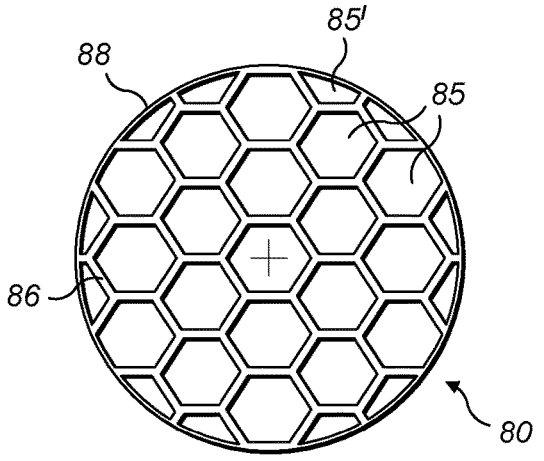
FIG. 8 shows a schematic end view of another example of an aerosol-cooling element for use with an apparatus for heating smokable material.

Referring now to FIG. 8, there is shown a schematic end view of another example of an aerosol-cooling element 80 for use with an apparatus for heating and volatilizing smokable material. In this example, the element 80 is again cylindrical having a cross-section (as can be seen in FIG. 8), though other shapes are possible. In this example, the element 80 is a monolithic rod, that is, the rod is a block of a single material, and has plural through holes or lumen 85, 85'. In this example, the internal walls 86 of the element 80 are arranged such that the majority of the lumen 85 have a hexagonal cross-sectional shape when viewed from the end (as in FIG. 8), or at least a generally hexagonal cross-sectional shape. It will be understood that the lumen 85' at the periphery near the outermost wall 88 will have a different shape so as to accommodate the curved shape of the outermost wall 88, and that likewise outermost peripheral walls of some lumen 85 may be curved slightly again to accommodate the shape of the outermost wall 88. Nevertheless, as stated, the majority of the lumen 85 have a hexagonal cross-sectional shape or at least a generally hexagonal cross-sectional shape. In this way, the element 80 has what may be termed a honeycomb-like structure, which may have advantages in some applications. In this specific example, there are 19 (nineteen) hexagonal major through holes 85, and 12 (twelve) non-hexagonal minor through holes 85', which are sized and arranged such that the overall porosity longitudinally through the element 80 is around 70%.

Any of the elements 50, 60, 70, 80 of FIGS. 5 to 8 in one example is substantially incompressible, that is, the element 50, 60, 70, 80 is reasonably rigid and relatively large forces are required to compress the element 50, 60, 70, 80. In this way, the element 50, 60, 70, 80 can be self-supporting, requiring no further arrangement to support the element 50, 60, 70, 80 in use.

In one example, the element 50, 60, 70, 80 of FIGS. 5 to 8 is formed of a ceramic material. A ceramic material is an inorganic, non-metallic material, often a crystalline oxide, nitride or carbide material. Suitable examples include silicon carbide (SiC), silicon nitride ($Si_3N_4$), titanium carbide, and zirconium dioxide (zirconia), though other ceramic or non-ceramic materials may be used. In other examples the element 50, 60, 70, 80 of FIGS. 5 to 8 is formed of at least one polymer. The polymer may be for example a thermoplastic, such as for example a polyolefin, a polyester, a polyamides (or nylon, including for example nylon 6), a polyacrylic, a polystyrene, a polyvinyl, polytetrafluoroethylene (PTFE), polyether ether ketone (PEEK), a polyether block amide; a polyolefin such as for example polyethylene, polypropylene, polybutylene and polymethylpentene; a polyester; a polyacrylic; a polystyrene; a polyvinyl such as for example ethylene vinyl acetate, ethylene vinyl alcohol and polyvinyl chloride; and any copolymer thereof, any derivative thereof, and any combination thereof.

The element 50, 60, 70, 80 of FIGS. 5 to 8 may be formed initially as a solid block and the through holes 55, 65, 75, 85 formed by piercing or boring through the block. More efficiently however, particularly in the case that the element 50, 60, 70, 80 of FIGS. 5 to 8 is formed of at least one polymer, the element 50, 60, 70, 80 may be formed initially with the through holes 55, 65, 75, 85 for example by some suitable molding technique, which may optionally include extrusion and/or pultrusion for example.

As mentioned above, one application for cooling elements as described herein is in the main apparatus of a heating apparatus for heating smokable material, the main apparatus typically including a power supply, control circuitry and the like. Another application, also mentioned above, is for the cooling elements as described herein to be part of the consumable, which is inserted into or otherwise engaged with the main apparatus and discarded and replaced after use. The heater for heating the tobacco or other smokable material of the consumable may be provided as part of the main apparatus or the consumable or heaters may be provided in both in some cases.

Figure 9:
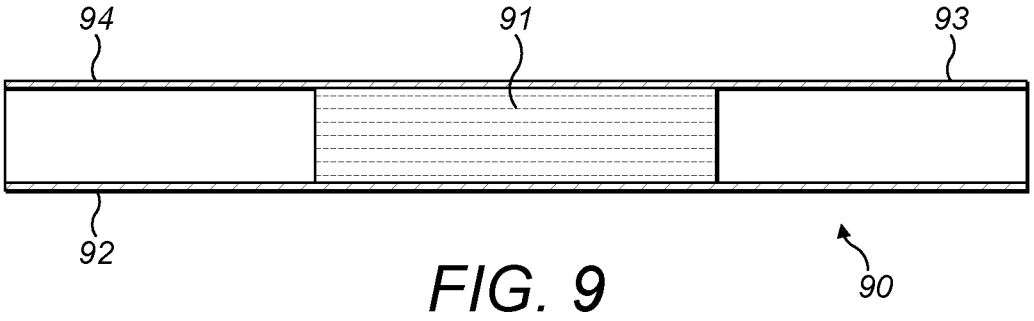
FIG. 9 shows schematically an example of an arrangement for use with an apparatus for heating smokable material.

FIG. 9 shows schematically an example of an arrangement 90 for use with an apparatus for heating smokable material and which incorporates a cooling element as described above. In this example, the arrangement 90 is a mouthpiece assembly 90. The mouthpiece assembly 90 may be part of or engaged in use with the main apparatus of a heating apparatus for heating smokable material or as part of the consumable, which is inserted into or otherwise engaged with the main apparatus and discarded and replaced after use. For clarity and simplicity, the following description will be in terms of the mouthpiece assemblies described herein being a part of the consumable, it being understood that the mouthpiece assemblies described herein may alternatively be part of or engaged in use with the main apparatus of a heating apparatus.

In this example, the mouthpiece assembly 90 has a single cooling element 91, which may be in accordance with any of the examples described above. On one side of the cooling element 91 (which in use is the mouth end), a first, mouth end hollow tube 92 abuts one end of the cooling element 91. The mouth end tube 92 may be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material. On the other side of the cooling element 91 is a second hollow tube 93 which spaces the cooling element 91 from the very hot part(s) of the main apparatus that heats the smokable material and thus protects the cooling element 91 from high temperatures, as well as helping to improve aerosol production as it can help to prevent condensation. The second tube 93 may again be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material. The mouth end tube 92 and the second tube 93 provide support for the cooling element 91. The mouth end tube 92 may have a filtering function and may sometimes be referred to as a tube filter.

The cooling element 91 in this example is located generally centrally of the mouthpiece assembly 90, but in other examples may be located more or less towards one end or the other of the mouthpiece assembly 90. In the example of FIG. 9, the mouth end tube 92, the cooling element 91 and the second tube 93 are held together by a tipping paper 94 which is wrapped tightly round the mouth end tube 92, the cooling element 91 and the second tube 93 to bind them together. In this sense, the mouthpiece assembly 90 is "pre-assembled". In one specific example, the first, mouth end tube 92 may be 11 mm long, the cooling element 91 may be 19 mm long, and the second tube 93 may be 11 mm long, and the outside diameter of the mouthpiece assembly 90 as a whole may be 5.4 mm. Excluding the tipping paper 94, the outside diameter of the cooling element 91, the mouth end tube 92 and the second tube 93 may for example be in the range 5.13 mm to 5.25 mm, with 5.25 mm being one preferred option. Other dimensions may be used, depending on for example the particular application, the typical temperature of the incoming aerosol or vapor, the nature (material) of the aerosol or vapor and smokable material, etc.

Figure 10:
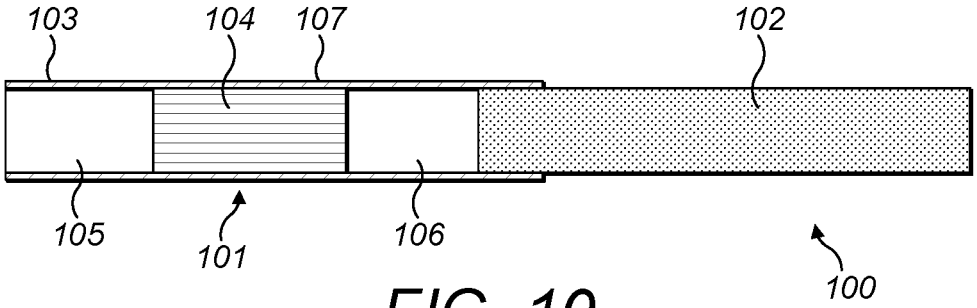
FIG. 10 shows schematically an example of a consumable for use with an apparatus for heating smokable material.

Referring now to FIG. 10, there is shown schematically an example of a consumable 100 for use with an apparatus for heating smokable material. The consumable 100 has a mouthpiece assembly 101 and a cylindrical rod of smokable material 102. The mouthpiece assembly 101 includes a cooling element which may be in accordance with any of the cooling elements described herein. In the example shown, the mouthpiece assembly 101 is generally the same as or similar to the mouthpiece assembly 91 described with reference to FIG. 9. That is, the mouthpiece assembly 101 is "pre-assembled", with tipping paper 103 that is wrapped around the cooling element 104, the mouth end tube 105 and the second tube 106. In this case, the mouthpiece assembly 101 may then be joined to the smokable material 102 by a further tipping paper 107, which is wrapped round the mouthpiece assembly 101 and at least the adjacent end of the smokable material 102. In other examples, the mouthpiece assembly 101 is not pre-assembled and instead the consumable 100 is formed by wrapping a tipping paper 107 around the cooling element 104, the mouth end tube 105, the second tube 106 and the smokable material 102 effectively in one operation, with no separate tipping paper being provided for the components of the mouthpiece parts.

Figure 11:
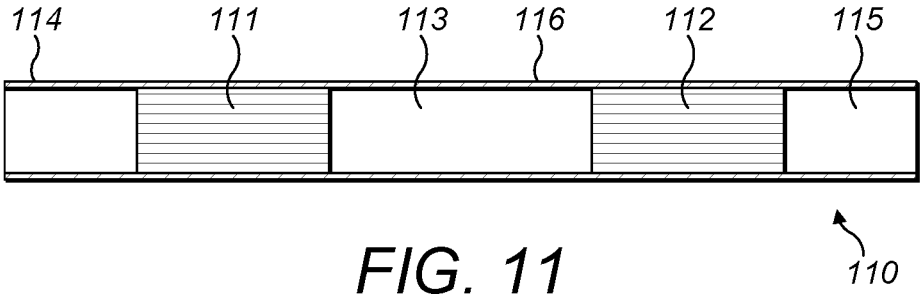
FIG. 11 shows schematically an example of a part-finished product.

FIG. 11 shows schematically an example of a part-finished product 110 during an example of a manufacturing process for manufacturing arrangements for use with an apparatus for heating smokable material, the arrangements each incorporating a cooling element as described above. The part-finished product 110 has two cooling elements 111, 112, which may be the same as or different from each other and which are each in accordance with any of the examples of cooling elements described herein. The two cooling elements 111, 112 are spaced from each other by a first, relatively long hollow tube 113. Additional hollow tubes 114, 115 are provided on the opposite ends of the cooling elements 111, 112. The tubes 113, 114, 115 may be formed of the same or different materials, and may for example be formed of any of the materials discussed in relation to the example of FIG. 9. The cooling elements 111, 112 and the tubes 113, 114, 115 may be joined to each other using tipping paper 116 which is wrapped tightly round cooling elements 111, 112 and the tubes 113, 114, 115 to bind them together. During manufacture, the central hollow tube 113 is cut through centrally, so as to provide two arrangements for use with an apparatus for heating smokable material, each of which incorporates a cooling element 111, 112 and each of which may be similar to the arrangement 90 as described above with reference to FIG. 9. It will be understood that this can be extended, so that further cooling elements with further spacing tubes may be provided in the part-finished product, to produce multiple arrangements as described herein.

Optionally, flavoring material may be included within any of the mouthpiece assemblies described herein. For example, a flavorant may be added to any of the tipping papers that are used in some examples to join components of the mouthpiece assembly together. Alternatively or additionally, one or more plugs of flavoring material may be introduced into one or more of the tubes of the mouthpiece assembly. Such a plug may for example be a cellulose acetate tow as a flavor carrier, to which a flavorant is added. As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

As mentioned above, a "consumable", which comprises smokable material, at least one cooling element and optionally at least one spacer or support tube (which may also provide a filtering function), may have its own heater, provided as part of the consumable element or device which is disposed of by the user after use. Alternatively, the heater for heating the smokable material may be provided as a component of the main apparatus (which typically includes a power supply, control circuitry and the like) with which the consumable is engaged for use. An example of the latter type of apparatus for heating smokable material with which examples of embodiments of the present invention may be used is shown in our PCT/EP2014/072828 and U.S. Provisional Patent Application No. 61/897,193, the entire contents of which are hereby incorporated by reference.

Figure 12:
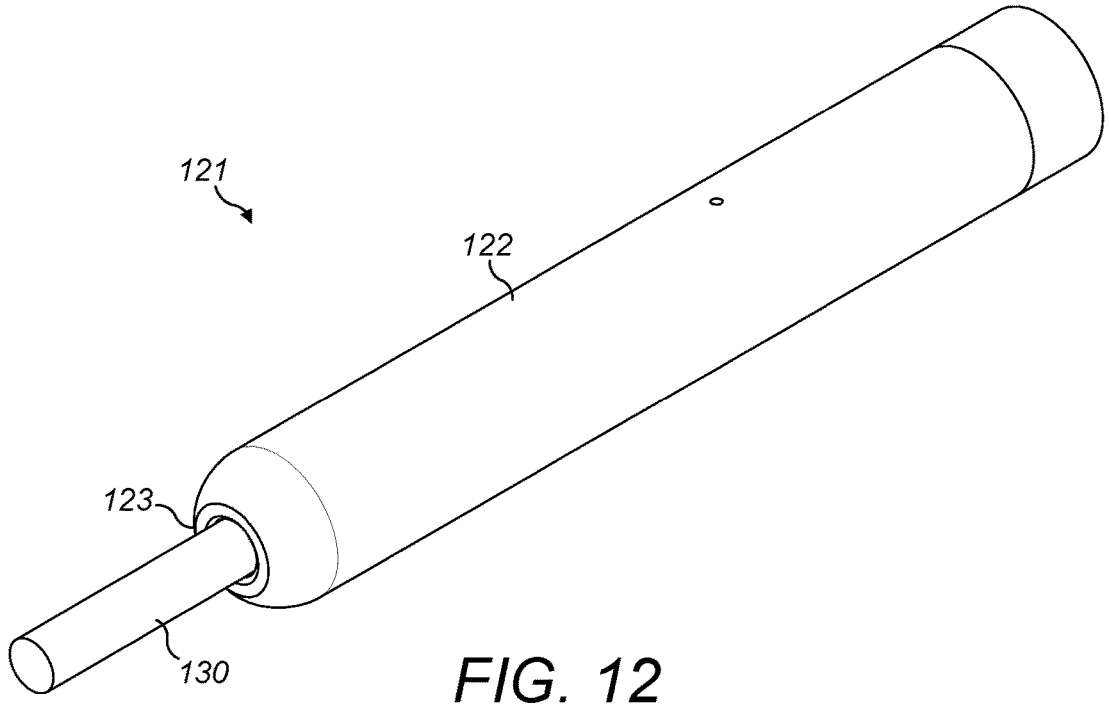
FIG. 12 shows a schematic perspective view of an example of an apparatus for heating a smokable material.
Figure 13:
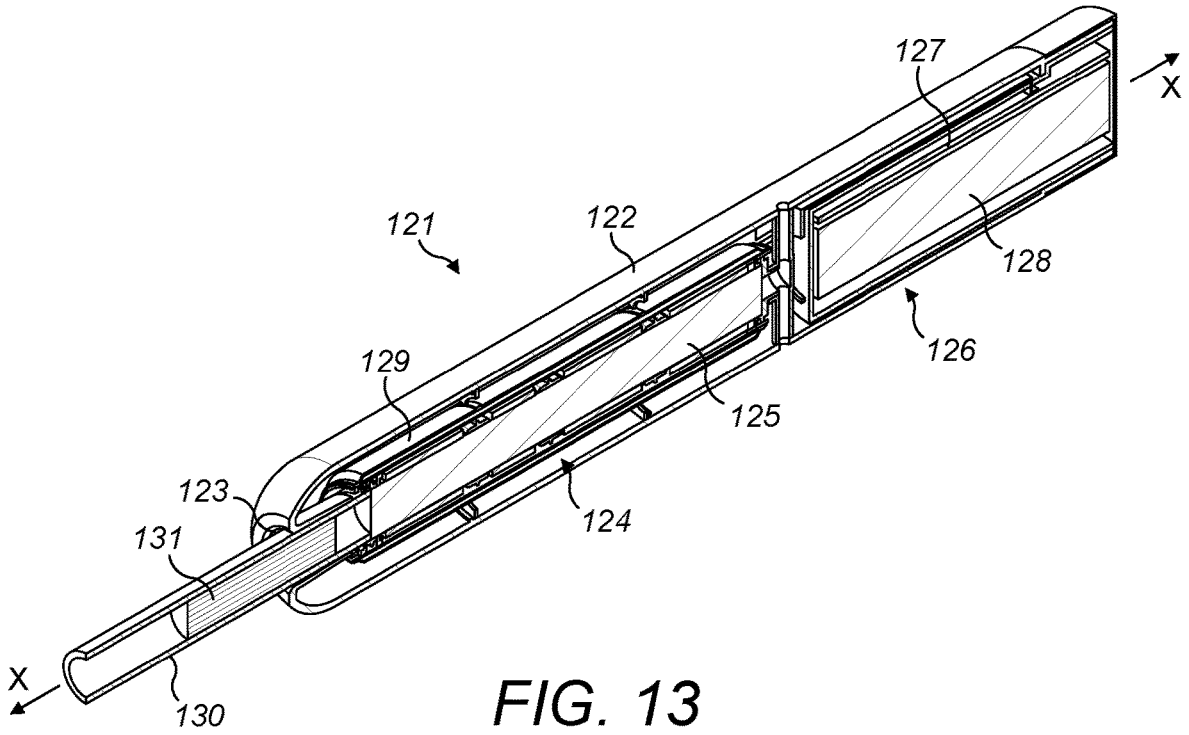
FIG. 13 shows a schematic cross-sectional perspective view of the apparatus of FIG. 12.
Figure 14:
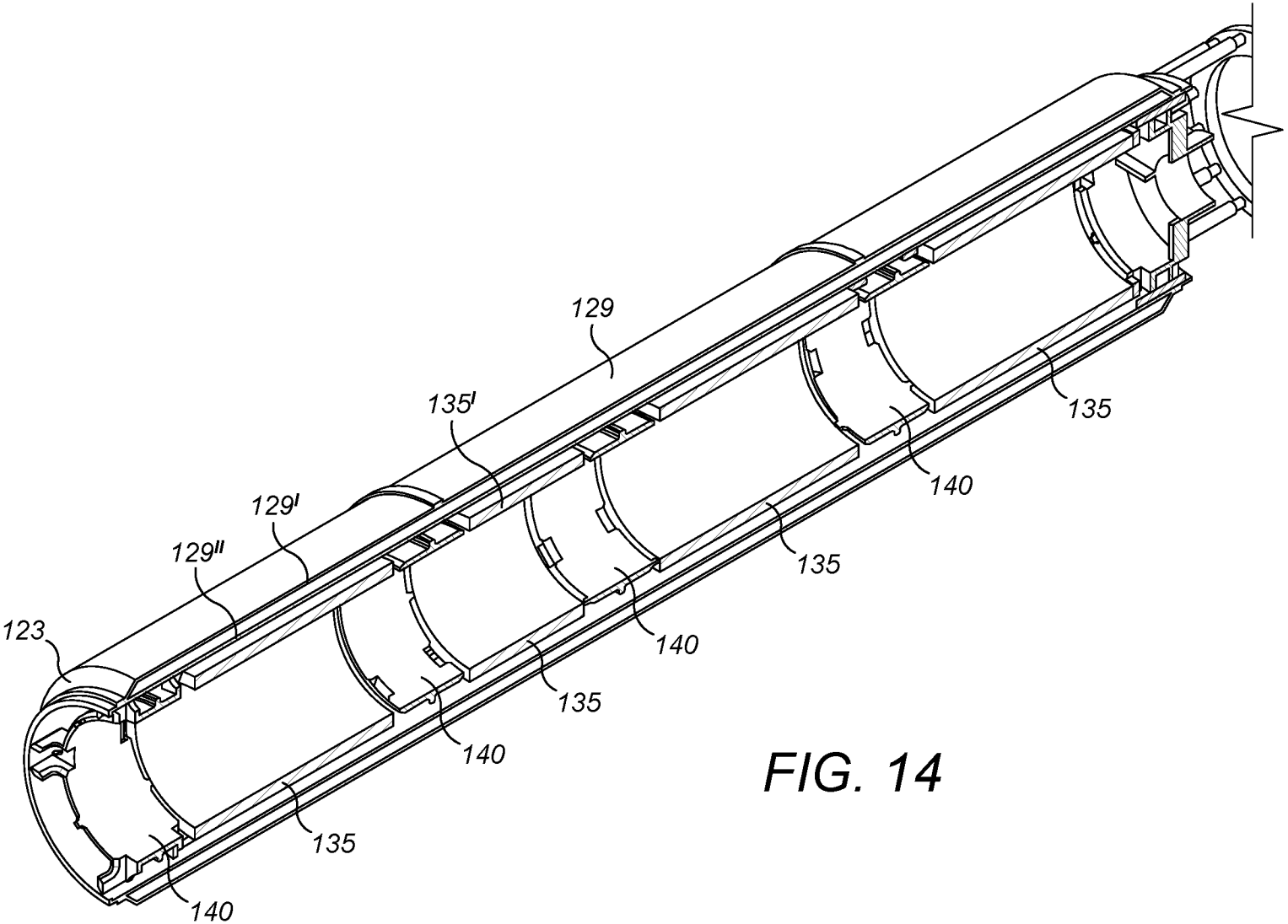
FIG. 14 shows a schematic cross-sectional perspective view of an example of a heater support sleeve and heating chamber suitable for use in the apparatus of FIG. 12.

FIGS. 12 and 13 show schematically a perspective view and a cross-sectional perspective view of a portion of an example of apparatus 121 disclosed in our PCT/EP2014/072828 and U.S. Provisional Patent Application No. 61/897,193, and FIG. 14 shows schematically a cross-sectional perspective view of an example of a heater support sleeve and heating chamber suitable for use in the apparatus 121 of FIGS. 12 and 13. In FIGS. 12 and 13, there is shown a consumable 130 inserted into the apparatus 121, the consumable 130 having at least a cooling element 131 in accordance with any of the examples described herein. The apparatus 121 is arranged to heat smokable material to volatilize at least one component of smokable material, typically to form an aerosol which can be inhaled. The apparatus 121 is a heating apparatus 121 which releases compounds by heating, but not burning, the smokable material. The apparatus 121 in this example is generally elongate, having a generally elongate cylindrical outer housing 122 of circular cross-section. The outer housing 122 has an open end 123, sometimes referred to herein as the mouth end.

Referring particularly to the cross-sectional view of FIG. 13, the apparatus 121 has a heating chamber 124 which in use contains the smokable material 125 to be heated and volatilized. The smokable material 125 is provided as part of a cylindrical rod-like consumable 130, which as mentioned in this example has a cooling element 121 which may be in accordance with any of the examples described above. The apparatus 121 further has an electronics/power chamber 126 which contains electrical control circuitry 127 and a power source 128. The heating chamber 124 and the electronics/power chamber 126 are adjacent each other along the longitudinal axis X-X of the apparatus 121. The electrical control circuitry 127 may include a controller, such as a microprocessor arrangement, configured and arranged to control the heating of the smokable material 125. The power source 128 may be a battery, which may be a rechargeable battery or a non-rechargeable battery.

The heating chamber 124 is contained within a heater support sleeve 129, which is contained within the outer housing 122. In this example, the heater support sleeve 129 is a generally elongate cylinder of circular cross-section. Further, and referring particularly to FIG. 14, the heater support sleeve 129 of this example is a double-walled sleeve. Thus, the heater support sleeve 129 has an outer cylindrical wall 129' and an inner cylindrical wall 129" which are separated by a small separation d. The outer and inner cylindrical walls 129', 129" are joined at each end. One of the functions of the heater support sleeve 129 is to assist in heat-insulating the outer housing 122 from the heating chamber 124, so that the outer housing 122 does not become hot or at least too hot to touch during use. The space between the outer and inner cylindrical walls 129', 129" may contain for example air or may be evacuated to improve the heat insulating properties of the heater support sleeve 129. As an alternative, the space between the outer and inner cylindrical walls 129', 129" may be filled with some other insulating material, including a suitable foam-type material for example. The heater support sleeve 129 is provides structural stability for the components mounted therein.

The heater support sleeve 129 contains at least one heating element. In the example shown in the drawings, the heater support sleeve 129 contains plural heating elements or heater segments 135. There are preferably at least two heater segments 135, though arrangements with other numbers of heater segments 135 are possible. In the particular example shown, there are four heater segments 135. In this example, the heater segments 135 align along or parallel to the longitudinal axis X-X of the heater support sleeve 129. The electrical control circuitry 127 and the power connections to the heater segments 135 are preferably arranged such that at least two, and more preferably all, of the heater segments 135 can be powered independently of each other, so that selected zones of the smokable material 125 can be independently heated, for example in turn (over time) or together (simultaneously) as desired. In this particular example, the heater segments 135 are generally annular or cylindrical, having a hollow interior which in use contains the smokable material 125. In an example, the heater segments 135 may be made of a ceramics material. Examples include alumina and aluminum nitride and silicon nitride ceramics, which may be laminated and sintered. Other heating arrangements are possible, including for example infrared heater segments 135, which heat by emitting infrared radiation, or resistive heating elements formed by for example a resistive electrical winding around the heater segments 135.

In an example, one 135' of the heater segments 135 may be such as to contain or define a volume that has a lower heat capacity or thermal mass, and/or itself may have a lower heat capacity or thermal mass, than the other heater segment or segments 135. This means that, at least for the same or similar supplied power, the interior of the heater segment 135' that has a lower heat capacity and/or defines a volume of lower heat capacity will heat more quickly than the interior of the other heater segments 135. This means that the smokable material 125 in that heater segment 135' will volatilize more quickly, which enables the user to inhale more quickly once the apparatus 121 is first put to use. It is preferred that this heater segment 135' is close to the mouth end 123, and it may therefore be for example the first or second heater segment 135 in sequence moving away from the mouth end 123. In the example shown in FIG. 13, this heater segment 135' is the second closest to the mouth end 123. The heater segments 135 are mounted and supported within the heater support sleeve 129 by mechanical isolators 140. The mechanical isolators 140 are rigid so as to provide mechanical, structural support for the heater segments 135. The mechanical isolators 140 act to maintain a separation or air gap between the heater segments 135 and the heater support sleeve 129, so as to reduce or minimize heat loss from the heater segments 135 to the heater support sleeve 129.

In use, the user inserts a fresh consumable 130 into the apparatus 121. The apparatus 121 is then activated to heat the smokable material 125. After use, the user removes the used consumable 130 from the apparatus 121 and typically discards the used consumable 130.

It has been found that using for example a cooling element 50, 60, 70, 80 as described above with reference to FIGS. 5 to 8, a reduction of temperature of the aerosol of around 50° C. can be achieved. As a generality, the more lumen that are present, the greater the internal surface area of the cooling element 50, 60, 70, 80, which tends to increase the amount of temperature reduction. Nevertheless, some structural rigidity is required of the cooling element 50, 60, 70, 80, and the internal walls also serve to conduct heat away. For the cooling elements with radially arranged lumen, the number of lumen may in general be in the range 20 to 50 lumen, and for the cooling elements with hexagonal or other polygonally arranged lumen, the number of lumen may in general be in the range 15 to 25 lumen.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol-cooling element for use with an apparatus for heating smokable material, the aerosol-cooling element comprising:

a rod having a first end and a second end and comprising plural tubes within the rod, the plural tubes extending between the first end and the second end so as to provide plural through holes extending between the first end and the second end of the rod, wherein the plural tubes serve to conduct heat away from aerosol passing through the plural through holes to cool the aerosol.

2. The aerosol-cooling element according to claim 1, wherein the rod is formed of a first material and the at least one tube is formed of a second material different from the first material.

3. The aerosol-cooling element according to claim 1, wherein the rod is formed of cellulose acetate.

4. The aerosol-cooling element according to claim 3, wherein the rod is formed of a cellulose acetate tow.

5. The aerosol-cooling element according to claim 1, wherein the at least one tube is formed of at least one of silicone rubber, ethylene vinyl acetate, or polypropylene.

* * * * *